US011041416B2

(12) United States Patent
Altherr et al.

(10) Patent No.: US 11,041,416 B2
(45) Date of Patent: Jun. 22, 2021

(54) VALVE TRAIN OF AN INTERNAL COMBUSTION ENGINE

(71) Applicant: Mahle International GmbH, Stuttgart (DE)

(72) Inventors: Patrick Altherr, Stuttgart (DE); Thorsten Ihne, Stuttgart (DE); Herrn R. Kirschner, Esslingen (DE); Mario Mohler, Stuttgart (DE); Markus Walch, Bretten (DE)

(73) Assignee: Mahle International GmbH

( * ) Notice: Subject to any disclaimer, the term of this patent is extended or adjusted under 35 U.S.C. 154(b) by 0 days.

(21) Appl. No.: 16/817,580

(22) Filed: Mar. 12, 2020

(65) Prior Publication Data

US 2020/0291831 A1 Sep. 17, 2020

(30) Foreign Application Priority Data

Mar. 13, 2019 (DE) ..... 102019203430.6

(51) Int. Cl.
*F01L 13/00* (2006.01)
*F01L 1/18* (2006.01)
(Continued)

(52) U.S. Cl.
CPC ..... *F01L 13/0047* (2013.01); *F01L 1/0532* (2013.01); *F01L 1/181* (2013.01);
(Continued)

(58) Field of Classification Search
CPC ... F01L 1/053; F01L 2001/0535; F01L 1/181; F01L 1/267; F01L 13/0036; F01L 2301/00; F01L 2301/02; F01L 2305/02
(Continued)

(56) References Cited

U.S. PATENT DOCUMENTS 8,191,524 B2 6/2012 Elendt et al.
8,714,125 B2 * 5/2014 Kamichika ..... F01L 1/18 123/90.39
(Continued)

FOREIGN PATENT DOCUMENTS

DE 102009053116 A1 9/2010
DE 102016205833 A1 10/2017
(Continued)

OTHER PUBLICATIONS

English abstract for DE-102016205833.
English abstract for DE-102016220612.

*Primary Examiner* — Jorge L Leon, Jr.
(74) *Attorney, Agent, or Firm* — Fishman Stewart PLLC

(57) ABSTRACT

A valve train of an internal combustion engine may include a camshaft, first and second cams, a rocker arm assembly having a displacement bolt, which may be adjustable between at least first and second positions in the axial direction and on which at least one cam roller, may be mounted in an axially fixed and rotatable manner, wherein the displacement bolt may be mounted in associated bearing lugs of the rocker arm assembly, a guide contour arranged on the camshaft and having first and second guide tracks, a switching pin, which may be arranged in the displacement bolt and which may optionally engage with the first or second guide track to adjust the displacement bolt between the first and second positions. In the first and second positions, the cam roller may cooperate with the first and second cams, respectively. First and second catch recesses may be provided on the displacement bolt. A catch device may engage with a catch element, which may be biased into the first or second catch recess and which may secure the displacement bolt in the first or second position. The first and second guide tracks may cross one another in a crossing region. A third catch recess may be provided between the
(Continued)

first and second catch recesses, wherein a first catch protuberance may be arranged between the first and the third catch recesses, and a second catch protuberance may be arranged between the second and the third catch recesses, wherein the catch element may engage with the third catch recess in the crossing region.

17 Claims, 2 Drawing Sheets

(51) Int. Cl.
*F01L 1/053* (2006.01)
*F01L 1/344* (2006.01)
*F01L 1/26* (2006.01)

(52) U.S. Cl.
CPC ..... *F01L 1/267* (2013.01); *F01L 1/34416* (2013.01); *F01L 13/0036* (2013.01); *F01L 2001/0535* (2013.01); *F01L 2013/0052* (2013.01); *F01L 2301/00* (2020.05); *F01L 2301/02* (2020.05); *F01L 2305/02* (2020.05)

(58) Field of Classification Search
USPC ..... 123/90.16, 90.17, 90.21, 90.27, 90.39, 123/90.44
See application file for complete search history.

(56) References Cited

U.S. PATENT DOCUMENTS

| | | | | |
|---|---|---|---|---|
| 10,371,020 | B2 | 8/2019 | Altherr et al. | |
| 2009/0095241 | A1* | 4/2009 | Ihlemann | F01L 13/0036 123/90.16 |
| 2017/0241305 | A1* | 8/2017 | Xi | F01L 1/08 |
| 2017/0362967 | A1* | 12/2017 | Altherr | F01L 13/0036 |

FOREIGN PATENT DOCUMENTS

| | | | | |
|---|---|---|---|---|
| DE | 102016209600 | A1 * | 12/2017 | F01L 1/047 |
| DE | 102016210679 | A1 | 12/2017 | |
| DE | 102016220612 | A1 | 4/2018 | |

* cited by examiner

VALVE TRAIN OF AN INTERNAL COMBUSTION ENGINE

CROSS-REFERENCE TO RELATED APPLICATIONS

This application claims priority to German Patent Application Number DE 10 2019 203 430.6, filed on Mar. 13, 2019, the contents of which are hereby incorporated by reference in their entirety.

TECHNICAL FIELD

The present invention relates to a valve train of an internal combustion engine comprising a camshaft comprising a first cam and a second cam arranged axially adjacent thereto, and comprising a rocker arm assembly. The invention furthermore relates to a displacement bolt for a valve train of this type.

BACKGROUND

Generic valve trains of an internal combustion engine are known, which, on a camshaft, have at least one first as well as at least one second cam, which is arranged axially adjacent thereto, for a valve train. Likewise provided is a rocker arm assembly comprising a displacement bolt, which can be adjusted between at least two positions in the axial direction and on which at least one cam roller is mounted in an axially fixed and simultaneously rotatable manner. The displacement bolt is thereby mounted in associated bearing lugs of the rocker arm assembly, wherein the cam rollers tap a cam profile of the first or second cam. A guide contour comprising a first guide track and a second guide track is arranged on the camshaft itself, wherein a displacement of the displacement bolt takes place via a switching pin, which is arranged in the displacement bolt and which optionally engages with the first or second guide track and thus adjusts the displacement bolt between its two positions, in which the associated cam roller cooperates either with the first cam or the second cam. In a first position of the displacement bolt, the cam roller thus cooperates with the first cam, i.e. a first cam profile thereof, and in a second position of the displacement bolt it cooperates with the second cam. In addition, a first catch recess and a second catch recess, which is arranged axially adjacent thereto in the axial direction of the displacement bolt, is usually arranged on the displacement bolt, wherein the displacement bolt is secured in the first or the second position, in that a catch device engages with a catch element, which is biased into the first or the second catch recess.

The two guide tracks of the guide contour can thereby run independently of one another, wherein an operating device is usually provided in this case, which operates the switching pin or the switching pins on the displacement bolt and thus pushes them into the first guide track or the second guide track.

Guide contours comprising two guide tracks would also be possible, which cross one another in crossing region and are thus referred to as x-guide contour. Significant optimization potential as compared to adjusting systems comprising separate guide tracks, in particular with regard to an installation space and a cost optimization can be attained therewith by means of a reduction of the number of components, combined with the storage, logistics, and assembly costs, which can be reduced therewith. X-guide contours of this type, however, are usually not used in practice, because a region without guidance by means of a respectively associated groove edge exists in the crossing region of the two guide tracks, and because a collision with the web separating the guide track branches or a threading of the switching pin into the wrong guide track may thus occur. In the first case, there is a risk of damages to or a destruction of the switching pin, while a change of the operating mode is not possible in the second case.

Due to the fact that the switching pin is not guided in the crossing region in this case, the friction of the moved components (cam sleeve or displacement bolt, respectively) is a main influencing factor for a successful adjustment, in addition to an engine speed (certain initial speed). In the case of the variable valve train systems known from the prior art, the assembly to be displaced, i.e. for example an axially adjustable displacement bolt or a cam sleeve are held via spring-loaded catch elements, for example balls, in associated catch recesses, for example grooves, which define the end positions in a positive manner and which hold the respective adjustable element there, i.e. for example the cam sleeve or the displacement bolt. A cylindrical region, in which the spring, which biases the catch element into associated catch recesses is tensioned the most, is thereby located between the catch recesses, which results in high friction in response to the adjustment, which in particular complicates a switching by means of X-groove.

A high friction in response to the adjustment of the displacement bolt, a high installation space need, as well as high costs resulting therefrom are disadvantages of the known variable valve train systems.

SUMMARY

The present invention thus deals with the problem of specifying an improved or at least an alternative embodiment for a valve train of the generic type, which overcomes the disadvantages known from the prior art.

This problem is solved according to the invention by means of the subject matter of the independent claims. Advantageous embodiments are subject matter of the dependent claims.

The present invention is based on the general idea of forming a catch contour on a displacement bolt not only with two catch recesses, which are axially adjacent to one another, but to provide a third catch recess between these two catch recesses, whereby the friction in response to the adjustment can be minimized on the one hand, without thereby endangering the tight fit of the moved components, i.e. in the present case of the displacement bolt in its respective positions. The third catch recess is thereby limited in the axial direction by a first and a second catch protuberance, whereby a catch element is held reliably between the edges of the third catch recess and is pulled over the respective catch protuberance in the guided guide track region. In the case of the falling edge of the catch protuberance, the switching pin additionally experiences an additional acceleration from the portion of the spring force acting in the x-direction (axial direction of the displacement bolt). A guide contour comprising guide tracks crossing one another in a crossing region is furthermore provided, wherein the catch element engages with the third catch recess in this crossing region, and the spring element biasing the catch element into the third catch recess thus exerts a smaller force, whereby the friction can be reduced, in turn. The spring bias is thus minimal in the crossing region of the two guide tracks, wherein the second catch protuberance is only overcome after passing the crossing region. An installation space optimization can additionally be attained by means of the x-guide contour, whereby additional assembly and cost advantages can be realized. The valve train according to the invention of an internal combustion engine has a camshaft comprising at least one first cam and at least one second cam arranged axially adjacent thereto. The valve train furthermore has a rocker arm assembly comprising a displacement bolt, which can be adjusted between at least two positions in the axial direction (based on an axis of a displacement bolt) and on which at least one cam roller is mounted in an axially fixed and rotatable manner. The displacement bolt is thereby mounted or guided, respectively, in the associated bearing lugs of the rocker arm assembly. The above-described x-shaped guide contour comprising a first and a second guide track, which cross one another in a crossing region, is now arranged on the camshaft. A switching pin, which optionally engages with the first or the second guide track and thus adjusts the displacement bolt between its two end positions, is arranged in the displacement bolt. In the first end position, the at least one cam roller of the displacement bolt cooperates with the cam profile of the first cam, and in a second end position of the displacement bolt it cooperates with the cam profile of the second cam. A first catch recess and a second catch recess, which is arranged axially adjacent thereto, is now arranged on the displacement bolt itself, wherein a spring-biased catch element of a catch device engages with the first or the second catch recess and thus secures the displacement bolt in a first or second (end) position. According to the invention, the above-described third catch recess is now provided between the first catch recess and the second catch recess, which is arranged axially adjacent thereto, wherein a first catch protuberance is arranged between the first and the third catch recess, and a second catch protuberance is arranged between the second and the third catch recess, and wherein the catch element engages with the third catch recess in the crossing region of the two guide tracks, and via the latter reliably guides the switching pin over the crossing region, without having to fear that said switching pin collides with a web separating the two guide tracks or threads into the wrong guide track. Several advantages can thus be attained by means of the valve train according to the invention as compared to the variable valve train systems known from the prior art, which include in particular a reduction of the number of components and, associated therewith, a reduction of the storage and logistics costs, a reduction of the assembly efforts, as well as an installation space optimization and a reduction of the friction. In the present paragraph, the valve train is thereby always described with a displacement bolt, by means of which associated cam rollers are displaced, whereby it is obviously also clear that the described system can analogously also have axially stationary cam rollers as well as an axially displaceable guide contour on the camshaft, together with axially adjustable cams on the camshaft, in particular in the manner of a cam sleeve.

In the case of an advantageous further development of the solution according to the invention, the first catch protuberance and/or the second catch protuberance have a rounded or a pointy tip. The advantage of a rounded tip lies, for example, in a smoother transition and in a larger contact surface as compared to a pointy tip, whereby the bearing pressure on the catch element can be decreased and a wear can be reduced. However, a quicker and direct transition between the third catch recess and the first or the second catch recess or vice versa is possible with a pointy tip.

In the case of a further advantageous embodiment of the solution according to the invention, an edge of the first catch protuberance, which slopes to the third catch recess, has a larger down-grade than an edge, which slopes to the first catch recess. In addition or in the alternative it can also be provided that an edge of the second catch protuberance, which slopes to the third catch recess, has a larger down-grade than an edge, which slopes to the second catch recess. After overcoming the first or the second catch protuberance from the direction of the first or second catch recess, an axial displacement of the displacement bolt can be supported thereby and the switching pin can thus be reliably guided in the crossing region of the two guide tracks.

The catch recess advantageously has a ball, which is arranged on the bearing lug side and which is spring-biased into the first, the second or the third catch recess. A ball of this type provides for a low-friction adjustment of the displacement bolt on the one hand and simultaneously also a smooth transition between the individual catch recesses.

In the case of a further advantageous embodiment of the solution according to the invention, the third catch recess has a larger axial length L than the first catch recess and the second catch recess. It is possible thereby to guide the switching pin without any problems in the crossing region of the two guide tracks, and to simultaneously reliably secure the displacement bolt and thus the associated cam rollers in their position cooperating with the respective cam profile of the first or second cam through the first and second catch recess, which is shorter in the axial direction.

In the case of a further advantageous embodiment of the solution according to the invention, a radial height H of the first and/or second catch protuberance is smaller than a radius R of the displacement bolt. To overcome the first and/or second catch protuberance, a significantly lower spring bias is thus required on the catch element, whereby the adjustment movement can be facilitated and the wear can be reduced. However, the radial height H of the first and/or second catch protuberance is to simultaneously be dimensioned such that a reliable guidance of the catch element in the respective catch recess can be made possible and an unintentional change between the two adjacent catch recesses can be avoided.

The present invention is further based on the general idea of improving a displacement bolt for the above-described valve train or of a valve train of this type, respectively, in such a way that it does not only have a first catch recess and a second catch recess axially adjacent thereto, as before, but additionally a third catch recess, which is separated via a first catch protuberance to the first catch recess and via a second catch protuberance to the second catch recess between these two catch recesses. A guide contour for a switching pin comprising guide tracks crossing one another in a x-shaped manner in a crossing region is possible by means of a displacement bolt of this type, whereby a displacement bolt of this type is the basis for the above-described valve train according to the invention.

In the case of an advantageous further development of the displacement bolt according to the invention, the first catch protuberance and/or the second catch protuberance have a rounded or a pointy tip. The advantage of a rounded tip lies in a smoother transition and in a larger contact surface as compared to a pointy tip, whereby the bearing pressure on the catch element can be decreased and a wear can thus be reduced. However, a quick and direct transition between the third catch recess and the first or the second catch recess or vice versa is possible with a pointy tip.

In the case of a further advantageous embodiment of the displacement bolt according to the invention, the catch recess has a ball, which is arranged on the bearing lug side and which is spring-biased into the first, the second or the third catch recess. A ball of this type provides for a low-friction adjustment of the displacement bolt on the one hand and simultaneously also a smooth transition between the individual catch recesses.

In the case of a further advantageous embodiment of the displacement bolt according to the invention, a radial height H of the first and/or second catch protuberance is smaller than a radius R of the displacement bolt. To overcome the first and/or second catch protuberance, a significantly lower spring bias is thus required on the catch element, whereby the adjustment movement can be facilitated and the wear can be reduced.

Further important features and advantages of the invention follow from the subclaims, from the drawings, and from the corresponding figure description on the basis of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the following description, whereby identical reference numerals refer to identical or similar or functionally identical components.

BRIEF DESCRIPTION OF THE DRAWINGS

In each case schematically.

DETAILED DESCRIPTION

Figure 1:
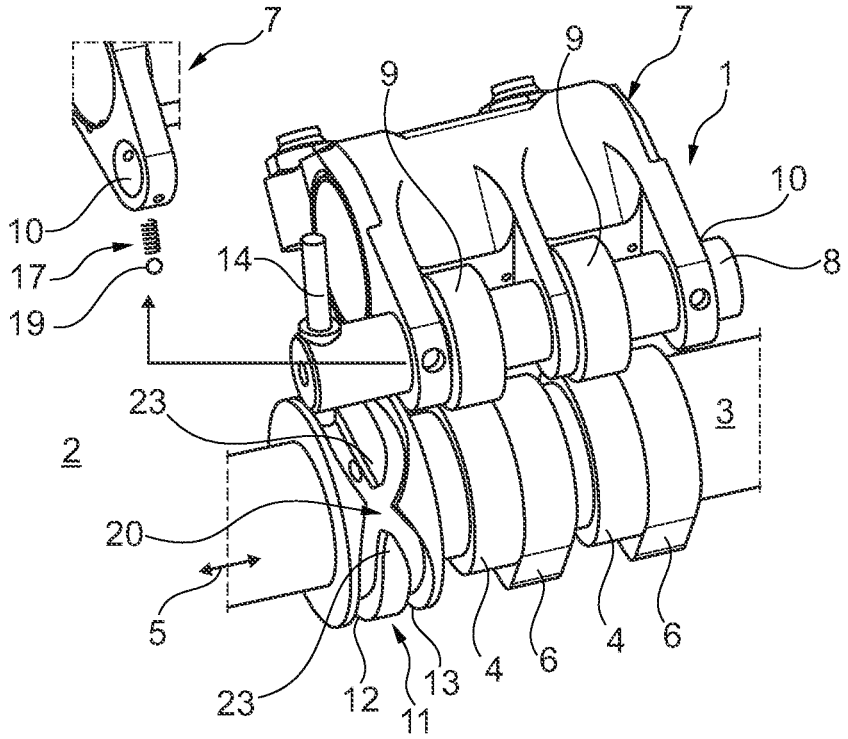
FIG. 1 shows a view onto a valve train according to the invention.

According to FIG. 1, a valve train 1 according to the invention of an internal combustion engine 2, which is not illustrated in more detail, has a camshaft 3 comprising a first cam 4 and a second cam 6 adjacent thereto in the axial direction 5. Also provided is a rocker arm assembly 7 comprising a displacement bolt 8 (also see FIGS. 2 and 3), which can be adjusted between at least two positions in the axial direction 5 and on which at least one cam roller 9, here two cam rollers 9, are mounted in an axially fixed and rotatable manner. The displacement bolt 8 is thereby mounted in associated bearing lugs 10 of the rocker arm assembly 7. A guide contour 11 comprising a first guide track 12 and a second guide track 13 is arranged on the camshaft 3. A switching pin 14, which optionally engages with the first or the second guide track 12, 13 (according to FIG. 1 with the second guide track 13) and thus adjusts the displacement bolt 8 between its two positions, is additionally arranged in the displacement bolt 8. In a first position of the displacement bolt 8, the cam roller 9 or the cam rollers 9, respectively, thereby cooperate with the first cam 4 (see FIG. 1), and in a second position of the displacement bolt 8 cooperates with the second cam 6. Different valve opening times or also a cylinder turn-off, for example, can be realized thereby.

Figure 2:
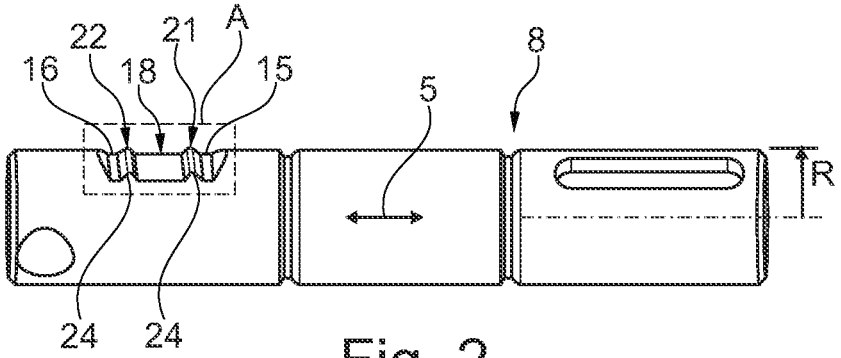
FIG. 2 shows a view onto a displacement bolt according to the invention.
Figure 3:
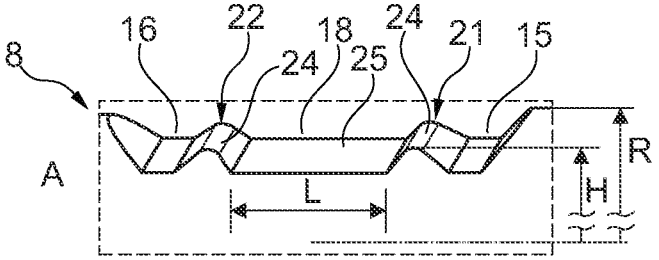
FIG. 3 shows a detail illustration A from FIG. 2.

A first catch recess 15 as well as a second catch recess 16, which is arranged axially adjacent thereto in the axial direction 5, is now arranged on the displacement bolt 8 (see FIGS. 2 and 3). A catch device 17 is furthermore provided comprising a catch element 19, which is spring-biased into the first, the second or a third catch recess 18 and which secures the displacement bolt 8 and via the latter the at least one cam roller 9 in the first position or the second position, provided that the catch element 19 engages with the first or second catch recess 15, 16.

When further looking at FIG. 1, it can be seen that the guide tracks 12, 13 cross one another in an x-shaped manner in a crossing region 20. According to FIGS. 2 and 3, the above-mentioned third catch recess 18 is provided between the first catch recess 15 and the second catch recess 16, which is arranged axially adjacent thereto, on the displacement bolt 8, wherein a first catch protuberance 21 is arranged between the first and the third catch recess 15, 18, and a second catch protuberance 22 is arranged between the second and the third catch recess 16, 18, whereby the catch element 19 engages with the third catch recess 18 in the crossing region 20 and is guided therein and thus reliably guides the switching pin 14 over the crossing region 20, without said switching pin colliding with a web 23 separating the two guide tracks 12, 13 or threading into the wrong guide track 12, 13 and a switch-over is thus not possible. With the third catch recess 18 according to the invention it is thus possible to use an installation space-optimized guide contour 11 comprising to guide tracks 12, 13, which cross one another, and to thus not only create an installation space-optimized, but also an assembly-friendly and cost-efficient valve train 1.

Figure 4:
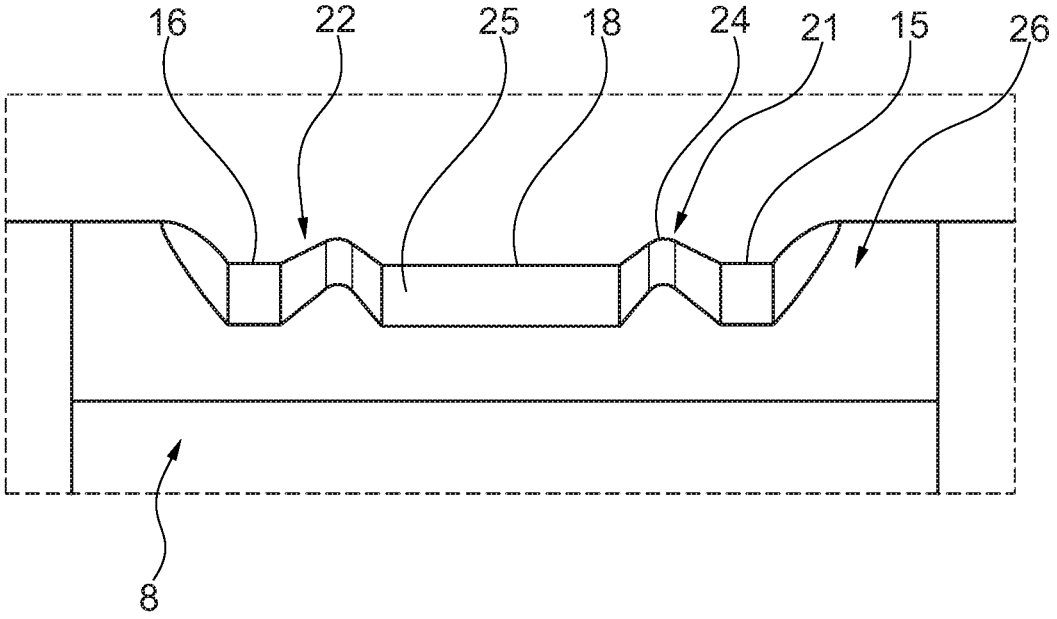
FIG. 4 shows a detail illustration of the displacement bolt according to the invention comprising a separately produced catch device.

When looking at FIGS. 2 to 4, it can be seen that the first catch protuberance 21 and/or the second catch protuberance 22 have a rounded tip 24. A smooth transition between the individual catch recesses 15, 18, 16 is possible thereby. It goes without saying that it can alternatively also be provided that the tips 24 are formed to be pointy, whereby a quick overcoming of the tip 24 is made possible and an axial force support for displacement of the displacement bolt 8 in the axial direction 5 can be provided, provided that the tip 24 is overcome.

According to FIGS. 2 and 3, the edge of the first catch protuberance 21, which slopes to the third catch recess 18, thereby has a larger down-grade than an edge, which slopes to the first catch recess 15, whereby a higher supporting force acting in the axial direction 5 for displacing the displacement bolt 8 in the axial direction 5 can be provided. The edge of the second catch protuberance 22, which slopes to the third catch recess 18, likewise also has a larger down-grade than the edge, which slopes to the second catch recess 16. When further looking at the individual catch recesses 15, 18, 16 according to FIGS. 2 and 3, it can be seen that the third catch recess 18 has a larger axial length L than the first catch recess 15 and the second catch recess 16, whereby a smooth adjustment of the adjustment bolt 8 in the crossing region 20 and simultaneously a reliable guidance of the switching pin 14 in the crossing region 20 is made possible. Due to the significantly smaller axial length of the first and second catch recess 16, a narrow axial guidance of the catch element 19 and thus a reliable guidance of the cam rollers 9 is forced here on the respective cam profile of the first or second cam 4, 6 A radial height H of the first and/or second catch protuberance 21, 22 is thereby smaller than a radius R of the displacement bolt 8, whereby the switching process and the displacement of the displacement bolt 8 can be facilitated. The edges on the first or second catch protuberance 21, 22, which fall to the third catch recess 18, can thereby be formed linearly, as indicated, or can transition concavely and thus without a kink into a bottom 25 of the third catch recess 18.

In addition to the entire valve train 1, the displacement bolt 8 according to the invention for a valve train 1 of this type is to also be protected, wherein, according to FIG. 2, said displacement bolt has the above-described first catch recess 15 as well as the second catch recess 16, which is arranged axially adjacent thereto, and a third catch recess 18, which is arranged therebetween in the axial direction 5. A first catch protuberance 21 is thereby arranged between the first and the third catch recess 15, 18, while a second catch protuberance 22 is arranged between the second and the third catch recess 16, 18. The first, second, and third catch recess 15, 16, 18 is formed as relief in this case. The catch device 17 is thus formed in one piece with the displacement bolt 8.

In the alternative, it is also conceivable that the catch recesses 15, 16, 18 and the first and second catch protuberances 21, 22 are part of a separate catch element 26, which consists of a different material than the remaining displacement bolt 8. In this case, the catch element 26 can thus be formed as insert, which engages with a corresponding recess on the displacement bolt 8. The catch element 26 can thereby be connected to the displacement bolt 8 in a non-positive manner, in a non-positive manner, in a positive manner, and/or in particular by means of a substance-to-substance bond, for example by means of soldering, adhering or welding.

The catch element 26 can also consist of or can have a ceramic material or a metal matrix composite material, preferably hard metal, whereby the wear resistance thereof can be significantly improved. The catch element 26 can also be produced without finishing to end contour by means of sintering, whereby a wear resistant component can likewise be created.

With the displacement bolt 8 according to the invention it is possible for the first time to use an installation space-optimized guide contour 11 comprising two guide tracks 12, 13, which cross one another in a crossing region 20, without having to fear thereby that, in response to the adjustment of the adjustment bolt 8 from its first into its second position and thus from a tapping change of the at least one cam roller 9 from the first to the second cam 4, 6 or vice versa, a threading into the wrong guide tack 12, 13 or a collision with a web separating the two guide tracks 12, 13 having to be feared.

In the case of the displacement bolt 8 according to the invention, the first catch protuberance 21 and/or the second catch protuberance 22 have a rounded tip 24, whereby a smooth transition is made possible between the individual catch recesses 15, 18, 16. The first and/or second catch protuberance 21, 22 can furthermore be cured, heat-treated and/or coated. By means of a curing, in particular the wear resistance can be increased, as well as by means of a coating, for example a DLC coating.

The invention claimed is:

1. A valve train of an internal combustion engine, the valve train comprising:

a camshaft including a first cam and a second cam arranged axially adjacent to the first cam;

a rocker arm assembly including:

a displacement bolt extending parallel to the camshaft and configured to be axially adjusted between at least a first position and a second position with respect to the rocker arm assembly; and at least one cam roller rotatably mounted on the displacement bolt;

a guide contour arranged on the camshaft, the guide contour including a first guide track and a second guide track; and a switching pin extending perpendicularly through the displacement bolt, the switching pin configured to alternately engage the first and second guide tracks so as to adjust the displacement bolt between the first and second positions;

wherein the at least one cam roller cooperates engages the first cam when the displacement bolt is in the first position, and the at least one cam roller engages the second cam when the displacement bolt is in the second position;

wherein the displacement bolt comprises a catch unit including a first catch recess and a second catch recess arranged axially adjacent to the first catch recess;

wherein the rocker arm assembly further includes a catch device configured to alternately bias a catch element into engagement with the first and second catch recesses so as to secure the displacement bolt in the first and second positions, respectively;

wherein the first and second guide tracks intersect each other in a crossing region of the guide contour;

wherein the catch unit further includes a third catch recess arranged between the first catch recess and the second catch recess, a first catch protuberance arranged between the first and third catch recesses, and a second catch protuberance arranged between the second and third catch recesses; and wherein the catch element engages the third catch recess when the switching pin is in the crossing region.

2. The valve train according to claim 1, wherein at least one of the first catch protuberance and the second catch protuberance has a rounded or pointed tip.

3. The valve train according to claim 1, wherein:

a first edge of the first catch protuberance, sloping towards the third catch recess, has a greater down-grade than a second edge of the first catch protuberance, sloping towards the first catch recess; and/or a first edge of the second catch protuberance, sloping towards the third catch recess, has a greater down-grade than a second edge of the second catch protuberance, sloping towards the second catch recess.

4. The valve train according to claim 1, wherein the catch element is formed as a ball.

5. The valve train according to claim 1, wherein:

an axial length of the third catch recess is greater than an axial length of the first catch recess and an axial length of the second catch recess; and/or a radial height of at least one of the first catch protuberance and the second catch protuberance is less than a radius of the displacement bolt.

6. The valve train according to claim 1, wherein at least one of the first catch protuberance and the second catch protuberance is at least one of cured, heat-treated, and coated.

7. A displacement bolt for a valve train, the displacement bolt comprising:

a catch unit including:

a first catch recess and a second catch recess arranged axially adjacent to the first catch recess;

a third catch recess arranged between the first catch recess and the second catch recess;

a first catch protuberance arranged between the first and third catch recesses; and a second catch protuberance arranged between the second and third catch recesses.

8. The displacement bolt according to claim 7, wherein at least one of the first catch protuberance and the second catch protuberance has a rounded or a pointed tip.

9. The displacement bolt according to claim 7, wherein:

a first edge of the first catch protuberance, sloping towards the third catch recess, has a greater down-grade than a second edge of the first catch protuberance, sloping towards the first catch recess; and/or a first edge of the second catch protuberance, sloping towards the third catch recess, has a greater down-grade than a second edge of the second catch protuberance, sloping towards the second catch recess.

10. The displacement bolt according to claim 7, wherein:

an axial length of the third catch recess is greater than an axial length of the first catch recess and an axial length of the second catch recess; and a radial height of at least one of the first catch protuberance and the second catch protuberance is less than a radius of the displacement bolt.

11. The displacement bolt according to claim 7, wherein at least one of the first catch protuberance and the second catch protuberance is at least one of cured, heat-treated, and coated.

12. The displacement bolt according to claim 7, wherein the catch unit is formed separately from the displacement bolt and consists of a different material than the rest of the displacement bolt.

13. The displacement bolt according to claim 12, wherein the catch unit consists of a ceramic material or a metal matrix composite material.

14. The displacement bolt according to claim 12, wherein the catch unit is sintered.

15. The displacement bolt according to claim 13, wherein the catch unit is connected to the displacement bolt via a substance-to-substance bond.

16. The valve train according to claim 1, wherein the catch unit is formed separately from the displacement bolt and consists of a different material than the displacement bolt.

17. The valve train according to claim 16, wherein the catch unit consists of a ceramic material or a metal matrix composite material.

* * * * *